United States Patent [19]

Hoshino

[11] Patent Number: 4,843,943

[45] Date of Patent: Jul. 4, 1989

[54] STRAP CONNECTION FOR A GUITAR OR STRINGED INSTRUMENT

[75] Inventor: Yoshihiro Hoshino, Nagoya, Japan

[73] Assignee: Hoshino Gakki Co., Ltd., Japan

[21] Appl. No.: 114,080

[22] Filed: Oct. 27, 1987

[30] Foreign Application Priority Data

May 15, 1987 [JP] Japan ..... 62-073460[U]

[51] Int. Cl.[4] ..... G10D 3/00

[52] U.S. Cl. ..... 84/327; 84/376 A; 224/910

[58] Field of Search ..... 84/327, 376 A; 224/910

[56] References Cited

U.S. PATENT DOCUMENTS 4,251,016 2/1981 O'Rafferty et al. ..... 84/327 X

*Primary Examiner*—L. T. Hix

*Assistant Examiner*—Brian W. Brown

*Attorney, Agent, or Firm*—Ostrolenk, Faber, Gerb & Soffen

[57] ABSTRACT

A strap connector for the body of a stringed instrument, such as a guitar, comprising two overlaid members, with the bottom member being more elongated than the top member to define a protective piece over the instrument body. A strap engagement ring is carried by the top member. That ring overlies the protective piece, whereby that piece protects the instrument body against contact with the ring. The strap connector is held to the body of the instrument by a projection from the instrument extending through a slit in the strap connector.

6 Claims, 2 Drawing Sheets

STRAP CONNECTION FOR A GUITAR OR STRINGED INSTRUMENT

BACKGROUND OF THE INVENTION

The present invention relates to the strap connection for a guitar, or the like stringed instrument. This connection is provided with a protective piece to protect the guitar body.

The strap of a guitar is connected on the guitar body to facilitate carrying the guitar. The strap is readily attachable and detachable for convenience at performance and for transporting the guitar.

In a conventional strap connection, a connective part, such as a ring, made of either plastic or metal, is provided for connecting the strap. The connective part is attached at the tip of a connector, which is made of leather. That leather connector has a slit that is hung on an engagement member which extends from the guitar body. Usually, attachment or detachment of the strap is carried out between the connective part and the hook member which is provided at the tip of the strap.

However, this connective part, such as a ring, of the strap connection sometimes generates a foreign sound when it contacts the guitar body or it damages the surface of the body while the guitar is being transported or used in a performance.

The recently adopted one-touch type strap installation member having the connector and the engagement hook member on the side of the strap presents a greater possibility that these members will touch the guitar body.

Since the connector may undergo comparatively free movement subsequent to the detachment of the strap, damage may occur to the guitar body due to the vibrations and shocks of transportation.

BRIEF DESCRIPTION OF THE PRESENT INVENTION

The object of the present invention is to provide a strap connector which is capable of avoiding the damage to the guitar body that would be caused by prior strap connectors and of preventing the generation of undesired sounds.

The strap connector of the present invention provides a protective piece for protecting the guitar body. It is installed beneath the connector piece of the connector and above the guitar body.

DESCRIPTION OF THE DRAWINGS

Further objects and features of the present invention are apparent from the following description and from the accompanying drawings in which.

DETAILED DESCRIPTION OF THE INVENTION

Figure 1:
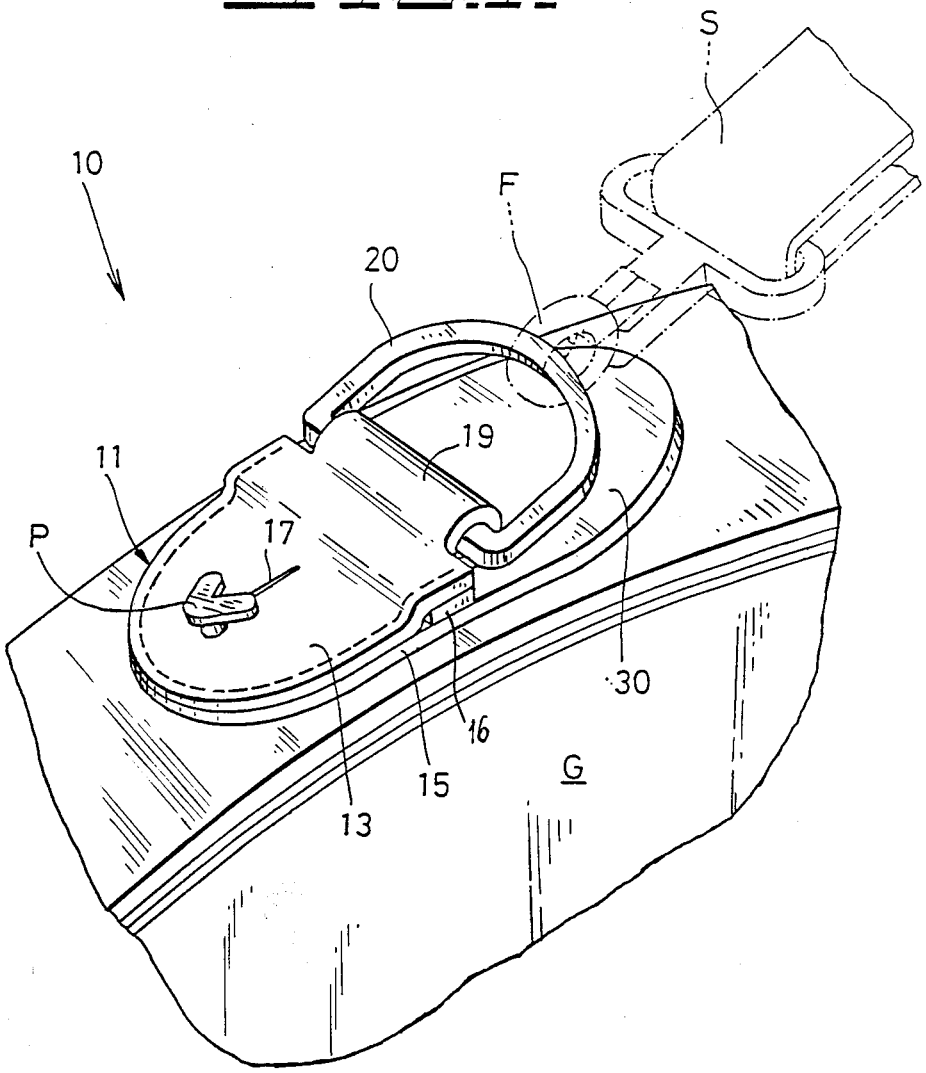
FIG. 1 is a perspective view showing a strap connector and the means of its engagement with a guitar body, according to the invention.

The strap connector 10 of FIG. 1 includes an installation piece 11, a connector piece 20 for the strap S and a protective piece 30 that is provided beneath the connector piece 20 to be between the connector piece 20 and the body of the guitar.

The installation piece 11 is made of a flexible yieldable material, such as leather or plastic. It includes the top side or surface member 13 and the bottom or reverse side member 15 which are sewn together. An integral extension of the bottom or reverse member 15 extends beyond the end of the top member to define the protective piece 30.

The reverse member 15 is secured in surface-to-surface contact together with the surface member 13. An engagement slit 17 is formed in the installation piece 11. This slit receives the engagement member P that extends from the guitar body G so that the installation piece 11 is hung on the member P.

The end of the top or surface member 13 of the installation piece 11 away from slit 17 is bent over at 19, e.g. to form a loop, and the connector piece 20 is installed at the bent over part 19.

The connector piece 20 is rigid and is comprised of either a metal or a plastic molded element. It is shaped generally in the form of a semicircular or D-ring. The flat side of the D is held by the top member of the piece 11 in a manner which permits the ring to pivot around the bend part 19, while the round part is engaged by a hook F.

A strap connection engagement member, in the form of an engagement hook F, is attached at the tip of the strap S. The hook F is connected with, i.e. hooked on this connector piece 20. The hook F may be a snap action or latch hook which may be snapped into position and the latch of which may be moved to disconnect.

Beneath the connector piece 20, there is a protective piece 30 which comprises an integral extension of the yieldable material reverse member 15 that extends beyond the connector piece 20. A separate protective piece 30 may be installed at the end of the reverse member 15. The piece 30 has sufficient flexibility to provide a buffer or protective effect. It may be made from leather or plastic. The protective piece has dimensions large enough for it to underlie the entire connector piece 20 and the engagement hook F. As a result of the dimensions and position of the protective piece 30, neither the connector piece 20 nor the engagement hook F can directly contact the guitar body G. This avoids generation of strange sounds during a performance and protects the body against contact damage.

Just behind the bent over part 19, the surface member 13 is spaced above the reverse member 15 by a spacer 16 which provides clearance for the part 19 and the straight leg of the D-ring piece 20 above the protective piece 30, so that the piece 20 may freely pivot.

Figure 2:
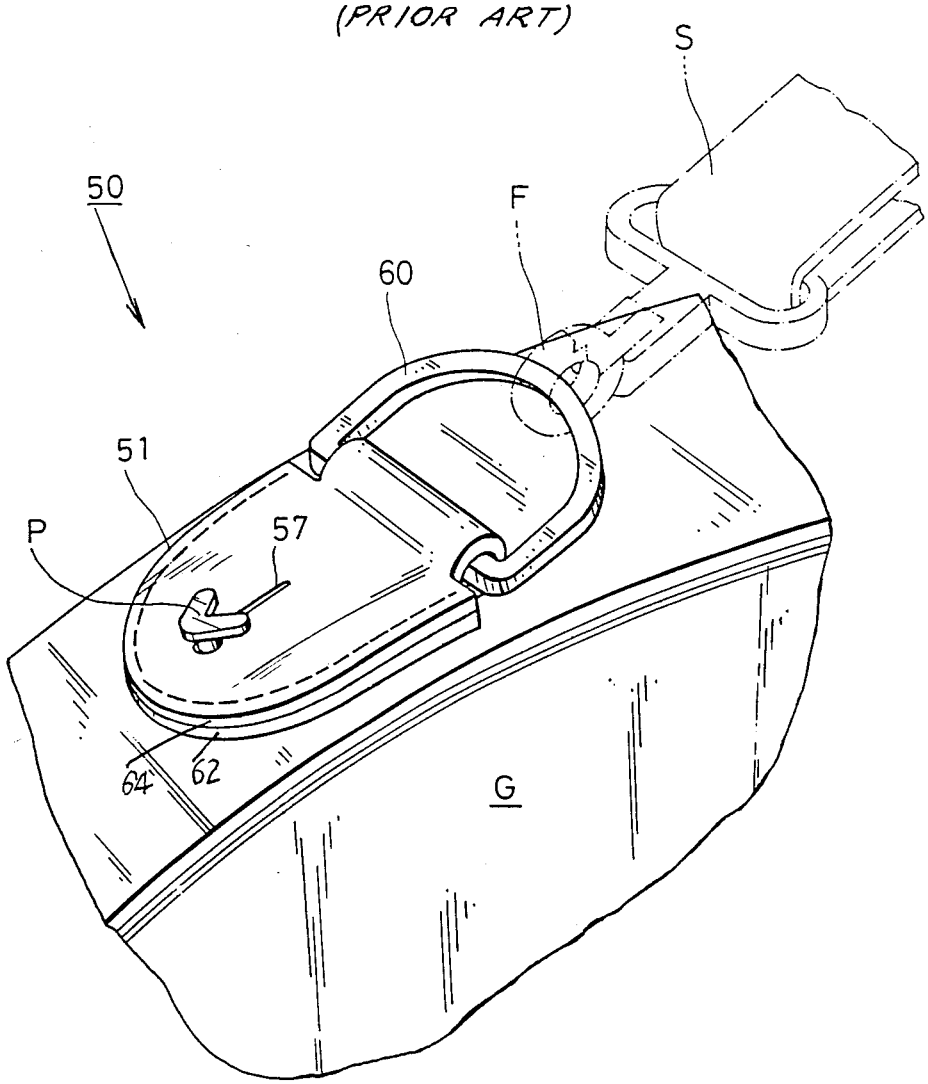
FIG. 2. (PRIOR ART)
FIG. 2 is the same type of view as FIG. 1, showing a prior art embodiment.

FIG. 2 illustrates a prior art embodiment. Elements corresponding in function to those in FIG. 1 are identified by a corresponding reference numeral raised by 40 and are not further described. Instead of a reverse member 15, there is a bottom or reverse member 62 of the same length and size as the top member 64. They extend up to but not beneath the D-ring connector piece 60, which is thus free to bang against the guitar body G.

In the foregoing, the invention has been described in connection with a preferred embodiment thereof. Since many variations and modifications will now be obvious to those skilled in the art, it is preferred that the scope of this invention be determined by the appended claims.

What is claimed is:

1. A strap connection for use on a stringed instrument, wherein a strap for use with the instrument has a strap connector engagement member, the strap connection comprising:

a bottom member for being secured to the body of the stringed instrument, a top member secured over the bottom member; the bottom member being of a length longer than the top member along the body of the instrument, and the part of the bottom member extending past the top member defining a protective piece for protecting the body of the stringed instrument;

a strap connector engagement member receiving ring; means on the top member of the connection for holding the ring for the ring to extend above the protective piece of the bottom member of the connection and the protective piece being shaped so that the entire ring could overlie the protective piece and so that the strap connector engagement member will engage the protective piece, whereby the protective piece would protect the body of the instrument from contact with the ring and the strap connector engagement member where it engages the ring;

said strap connection also comprising a spacer between the bottom and top members near the means on the top member for holding the ring for elevating the ring above the bottom member and the protective piece to enable the ring to move with respect to the top member.

2. The strap connection of claim 1, further comprising the strap connection being attached to the instrument through means projecting from the body of the instrument for engaging the strap connection, and means defined on the strap connection for receiving the projecting means from the body of the instrument for holding the strap connection to the body of the instrument.

3. The strap connection of claim 2, wherein the means projecting from the body of the instrument comprise a projection and the means on the strap connection for receiving the means projecting from the instrument comprise a slit in the strap connection for receiving the projecting means.

4. The strap connection of claim 1, wherein the bottom and top members of the strap connection are secured together in surface-to-surface relation.

5. The strap connection of claim 1, wherein the ring is D-shaped with the flat side of the D being received by the top member of the strap connection and the round side of the D being engaged by the strap connection engagement member on the strap.

6. The strap connection of claim 1 wherein the ring is supported to the top member of the strap connector in a manner permitting pivoting of the ring around its connection to the top member of the strap connector.

* * * * *